US011828112B2

(12) United States Patent
Bogue

(10) Patent No.: US 11,828,112 B2
(45) Date of Patent: Nov. 28, 2023

(54) COIL TUBING LATCH TOOL

(71) Applicant: Titanium Tubing Technology Ltd., Blackfoot (CA)

(72) Inventor: Christopher Bogue, Blackfoot (CA)

(73) Assignee: Titanium Tubing Technology Ltd., Lloydminster (CA)

( * ) Notice: Subject to any disclaimer, the term of this patent is extended or adjusted under 35 U.S.C. 154(b) by 123 days.

(21) Appl. No.: 17/584,769

(22) Filed: Jan. 26, 2022

(65) Prior Publication Data

US 2022/0235629 A1 Jul. 28, 2022

Related U.S. Application Data

(60) Provisional application No. 63/141,589, filed on Jan. 26, 2021.

(51) Int. Cl.

| | |
|---|---|
| ***E21B 17/04*** | (2006.01) |
| ***E21B 34/14*** | (2006.01) |
| ***E21B 23/03*** | (2006.01) |
| ***E21B 23/04*** | (2006.01) |

(52) U.S. Cl.
CPC ..... *E21B 17/04* (2013.01); *E21B 23/03* (2013.01); *E21B 23/0413* (2020.05)

(58) Field of Classification Search
CPC ..... E21B 23/04; E21B 23/02; E21B 17/041
See application file for complete search history.

(56) References Cited

U.S. PATENT DOCUMENTS

| | | | | |
|---|---|---|---|---|
| 2,988,146 A * | 6/1961 | Fredd | ..... | E21B 23/03 166/125 |
| 4,976,314 A * | 12/1990 | Crawford | ..... | E21B 23/03 166/117.5 |
| 2004/0226749 A1* | 11/2004 | Biglin, Jr. | ..... | E21B 23/02 175/320 |

* cited by examiner

*Primary Examiner* — Cathleen R Hutchins
(74) *Attorney, Agent, or Firm* — Bennett Jones LLP

(57) ABSTRACT

A running tool for deploying a secondary string into a wellbore with a primary tubing string includes a latch for selectively engaging a secondary string latching pin within the tool and means for activating the tool to disengage the latching pin from the tool.

9 Claims, 3 Drawing Sheets

COIL TUBING LATCH TOOL

CROSS REFERENCE TO RELATED APPLICATION

This application claims the priority benefit of U.S. Provisional Patent Application No. 63/141,589, filed on Jan. 26, 2021, the entire contents of which are incorporated by reference.

FIELD OF THE INVENTION

The present invention relates to a running tool for deploying a secondary string such as an instrumentation or capillary string into a wellbore, using a primary tubing string such as coil tubing.

BACKGROUND OF THE INVENTION

It is often desirable to use downhole sensors to provide data representing wellbore conditions, such as temperature or pressure. The sensors connect to surface instrumentation by means of an instrumentation string, which may comprise capillary tubing or other small diameter conduits which may house wires or cables.

Capillary tubing strings may also have other uses, such as to deliver treatment fluids or gases downhole.

Various alternative methods exist to run in an instrumentation or capillary string, such as by using coil tubing. There is a need in the art for alternative systems or methods of releasably attaching an instrumentation or capillary string to coil tubing for such purposes.

SUMMARY OF THE INVENTION

The present invention relates to a running tool for deploying a secondary string using a primary tubing string, the secondary string having a latching pin defining a latch notch.

In one aspect, the invention may comprise a running tool for deploying a secondary string into a wellbore with a primary tubing string, the tool comprising a latch for selectively engaging a secondary string latching pin within the tool and means for activating the tool to disengage the latching pin from the tool.

In another aspect, the invention comprises a tool comprising:

(a) a housing adapted to connect to a far end of the primary tubing string, and defining an elongate slot along its length for through passage of a far end of the latching pin into the housing, and a transverse bypass port for fluid communication from inside to outside of the housing;

(b) a piston comprising a piston head slidingly disposed within the housing and responsive to fluid pressure for moving the piston from a running position to an unlatched position, and a push rod extending from the piston head and having a latch profile, the piston head having a valve with a valve passage in fluid communication with a transverse bypass passage which aligns with the housing bypass port when the piston is in a running position;

(c) a latch body disposed in the housing and defining an elongate channel configured to receive a far end of the push rod, a pin channel configured to receive the far end of the latching pin, and a transverse channel connecting the elongate channel and the pin channel; and (d) a latch dog disposed within the transverse channel;

(e) wherein when the piston is in the running position, the latch dog engages the latching pin notch, and when the piston is in the unlatched position, the latch dog engages the push rod latch profile and disengages from the latching pin profile.

In another aspect, the invention may comprise a tool for deploying a secondary string having a latching pin defining a latch notch, using a primary tubing string, the tool comprising:

(a) a housing adapted to connect to a far end of the primary tubing string, and defining an elongate slot along its length for through passage of a far end of the latching pin into the housing, and a bypass port for fluid communication from inside to outside of the housing;

(b) a piston slidingly disposed within the housing and moveable between an upper open position and a lower running position, the piston comprising a piston head and a push rod extending from the piston head and having a latch profile;

(c) a valve disposed within the piston head, allowing fluid communication with the bypass port when open, and closing the tool to fluid pressure above the tool when closed;

(d) a latch body slidingly disposed in the housing and moveable between an upper open position and a running lower position, the latch body configured to receive a far end of the push rod and a far end of the latching pin;

(e) a latch dog disposed within a transverse channel defined by the latch body;

(f) wherein when the piston and the latch body are in the open position, the latch dog engages the push rod latch profile, allowing entry of the latching pin into the latch body, and when the piston and latch body are in the running position, the latch dog is pushed into the latching pin latch notch by the push rod latch profile, securely retaining the latching pin in the latch body.

In another aspect, the present invention comprises a method of running a secondary string into a wellbore using a primary tubing string having a running tool, comprising the steps of:

(a) configuring the secondary string with a latching pin;

(b) connecting the secondary string to the running tool using the latching pin, wherein the running tool is configured in a running state to releasably engage the latching pin; and (c) pulling the secondary string into the wellbore with the primary string.

When it is desired to release the secondary string, the running tool is activated, such as by dropping a ball to seat in a ball valve. Once the ball is seated, the tubing string may be pressured up to slide a piston downwards, which disengages a latch dog from a latching pin notch. The latching pin may then be removed from the running tool by pulling upwards on the string, or pushing downwards on the coil tubing string.

BRIEF DESCRIPTION OF THE DRAWINGS

In the drawings, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION OF EMBODIMENTS OF THE INVENTION

Figures 1, 2:
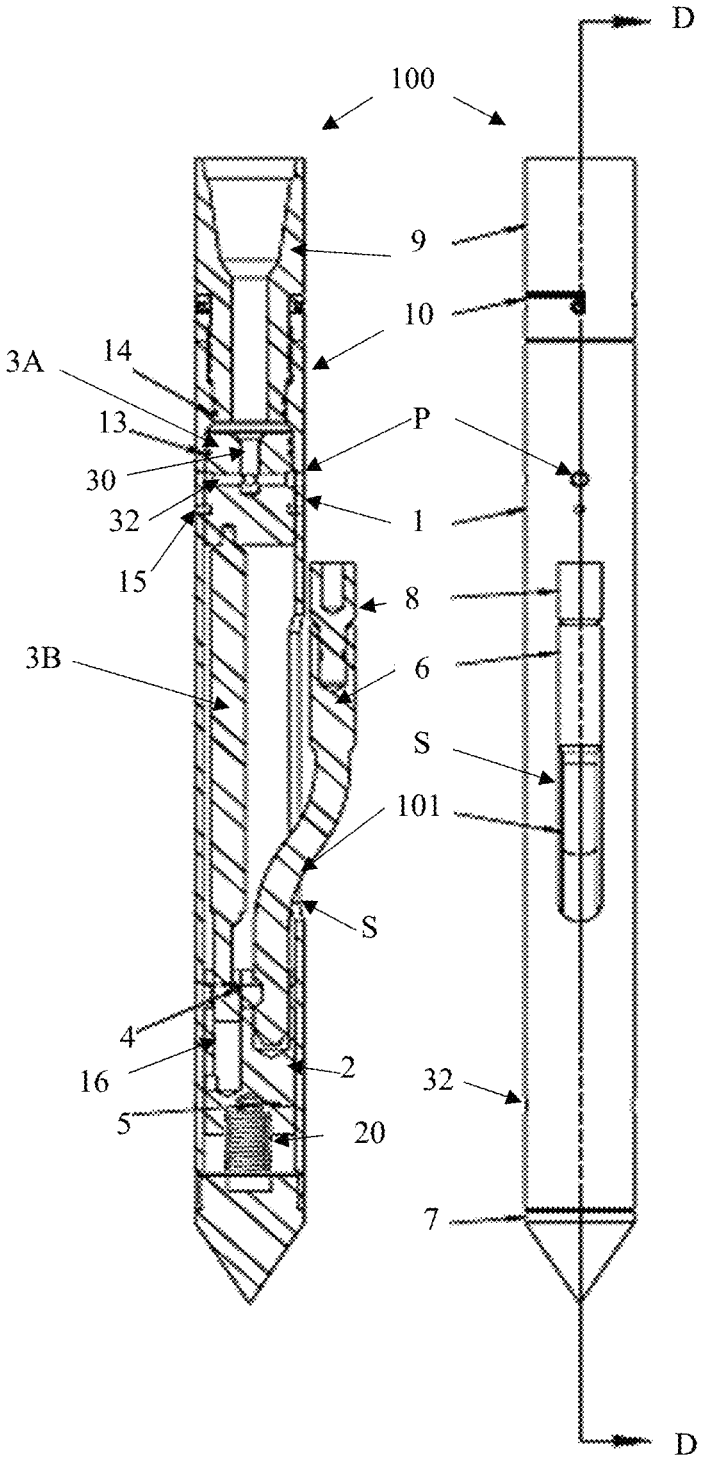
FIG. 1 is a side view of an embodiment of a running tool of the present invention, with a latching sub attached thereto.
FIG. 2 is side cross-sectional view of the running tool and latching sub of FIG. 1, along section line D-D, with the piston of the running tool in the running position.

The present invention relates to a running tool for deploying a secondary tubing string in a wellbore, using a tubing string. Any term or expression not expressly defined herein shall have its commonly accepted definition understood by a person skilled in the art.

The term "axial" or "longitudinal" describes the direction coinciding with the central longitudinal axis of a wellbore, a tubing string, or the running tool (100) of the present invention, or part thereof, as the case may be. The term "radial" or "transverse" describes a direction perpendicular to the axial direction. In FIGS. 1 to 5, the axial or longitudinal direction is in the vertical direction of the drawing plane.

The terms "far" and "near", and like terms, describe relatively axially downhole and uphole parts, respectively, without limiting their elevation in use. The far end of an element or apparatus is at the opposing end, away or downhole from surface components, while the near end is closer to surface components, or uphole from the far end. In FIGS. 1 to 5, the far end of the running tool (100) is toward the bottom of the drawing plane.

The term "secondary string" means any tubing string or cable which may be deployed using a primary tubing string. A secondary string may include instrumentation strings, capillary tubing, a cable or a cable bundle (encapsulated or not). The primary tubing string (also referred to simply as the tubing string) may include coiled tubing or a jointed tubular string. The tubing string is preferably a coil tubing string.

In general, as shown in FIGS. 1 and 2, the running tool (100) is used in combination with a latching sub (6) attached to a far end of a secondary string (not shown). In one aspect, the tool (100) comprises a housing (1) adapted to connect to a far end of a tubing string (not shown) with a standard threaded sub (9) and lock ring (10), which may be sealed with a O-ring (14). The housing (1) defines an elongated axial slot opening (S) along its length and at least one, and preferably a plurality of transverse bypass ports (P). A conventional end cap (7) is attached to the far end of the housing (1).

The latching sub (6) comprises a shear sub (8) and a latching pin (101), which has a curved configuration, permitting insertion of the far end of the latching pin (101) through the slot (S) and into the housing (1). Referring to FIGS. 2 to 5, the latching pin (101) defines a notch for engaging a latch dog (4) to restrain movement of the latching pin (101). The shear sub (8) provides the ability to disconnect the secondary string from the latching pin (101) if the need arises, by pulling on the secondary string to detach the shear sub (8) from the latching pin (101), which remains attached to the running tool (100).

FIG. 2 shows the tool in a running position where the latching pin (101) has engaged the latch dog (4). A piston (3A, 3B) comprises a piston head (3A) which is slidingly disposed within the housing and preferably sealed with at least one O-ring seal (13). The piston (3A, 3B) also comprises a downward extending push rod (3B) having a latch profile at the far end. The piston head (3A) has a valve which defines a valve passage (30) and radially extending bypass passages (32) which align with the housing bypass ports (P) when the piston (3A, 3B) is in a running position. Thus fluid may circulate from the tubing string into the housing (1), through the valve passage (30), through the aligned bypass passages (32) and out of the running tool (100) through the bypass ports (P) while the valve is open. The piston (3A, 3B) may be retained in the running position by at least one shear pin (15) which engages the piston (3A, 3B) and the housing (1). The number and size of the shear pins (15) may be selected to determine the activation pressure of the tool (100).

Figure 4:
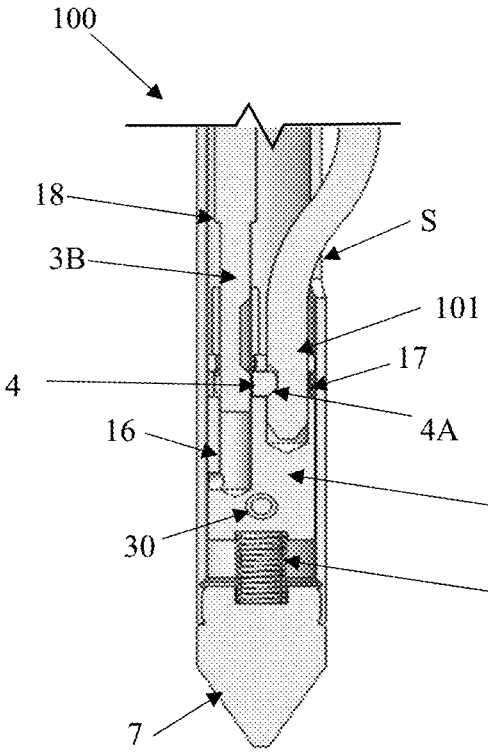
FIG. 4 is a cut-away view of a portion of the running tool and latching sub of FIG. 1, with the piston of the running tool in the running position.
Figure 5:
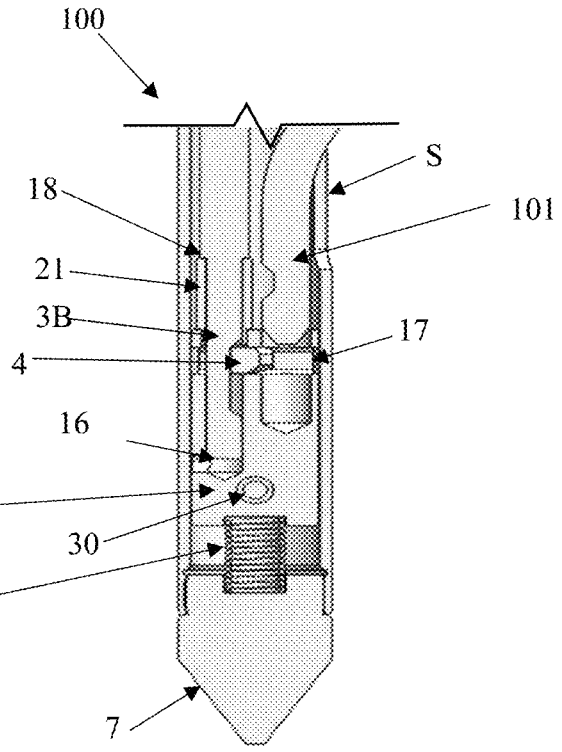
FIG. 5 is a cut-away view of a portion of the running tool and latching sub of FIG. 1, with the piston of the running tool in the ready position.

A latch body (2) is slidingly disposed within the housing (1) and defines a first elongate channel (16) configured to receive a far end of the push rod (3B) and a second elongate pin channel (17) configured to receive the far end of the latching pin (101). A transverse channel (19) connects between the elongate channel and pin channel. The latch dog (4) is disposed within the transverse channel and moves transversely to engage the latching pin (101) notch when the piston (3A, 3B) is in a running position as shown in FIGS. 2 and 4, or the push rod (3B) profile when the piston (3A, 3B) is in an open or unlatched position as shown in FIG. 3A or 5, respectively.

Figure 3A:
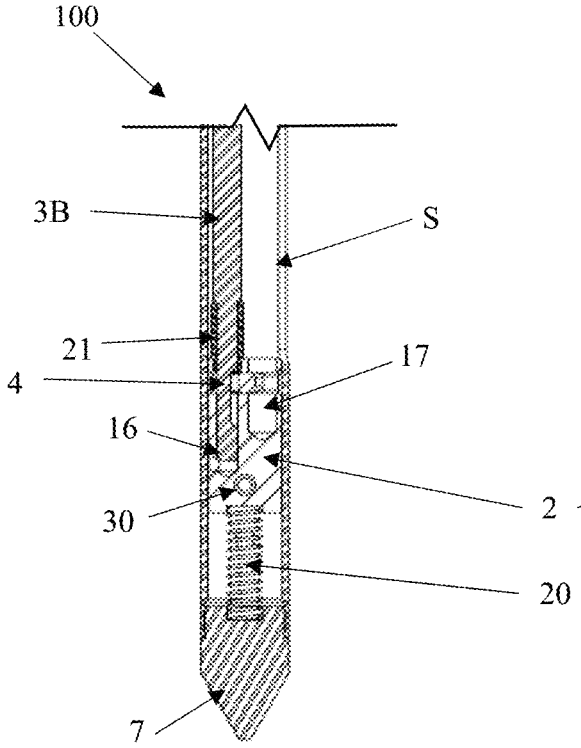
FIG. 3A is a cut-away view of a portion of the running tool in an open position, prior to insertion of the latching sub.
Figure 3B:
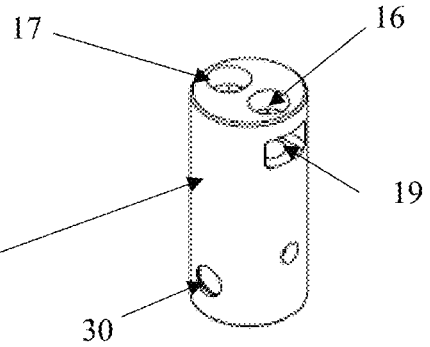
FIG. 3B is a pictorial view of a latch body in isolation.

In the open position, prior to insertion of the latching pin (101), the latch body is biased upwards by spring (20), such that the latch dog is positioned opposite an upper end of the push rod (3B) profile, when the piston (3A, 3B) is in its upper position, as shown in FIG. 3A.

In some embodiments, the latch body (2) defines a small lateral pocket or port that allow any debris or fluid present in the elongate channel (16) to flow out of that channel as the push rod (3B) moves into the channel.

In some embodiments, a sleeve seal (21) extends above the latch body (2) and is disposed around a lower end of the push rod (3B) to keep debris out of the latch body.

When the latching pin (101) in inserted into the housing and the pin channel (17), the latch dog (4) engages the latching pin profile, and the entire latch body (2) is moved downwards, compressing spring (20). The latch dog (4) moves downward with the latching pin (101) and is then positioned opposite the far end of the push rod (3B) profile, which has remained stationary while the latch body has moved downward. The latch dog is now locked into the latching pin (101) notch.

Retaining pins (30) positioned within the latch body (2) are spring biased outwards and when the latch body has moved into the running position, the pins (30) are pushed outwards and mate with opening (32) in the housing. The latch body (2) is now locked into the running position, where the latching pin (101), latch body (2) and piston (3A) are all locked into position. The primary string may then be lowered or inserted into the wellbore, taking the secondary string with it.

In an embodiment where the primary string is a coil tubing string, the primary string is deployed with a coil tubing injector, as is well known in the art. The secondary string may also be deployed with an injector, which permits retrieval of the secondary string independently of the primary string.

When it is desired to release the secondary string, the (100) may be activated by closing the valve. In some embodiments, the piston head (3A) valve is a ball valve, which is open in the running position and fluid can flow through the piston head. The ball valve can be closed by dropping a ball (not shown) into the primary tubing until it reaches the piston head (3A) and seats in a valve seat. Once the ball is seated, the valve passage (30) is closed, and the tubing string may be pressured up sufficiently to shear the shear pins (15) and to slide the piston (3A, 3B) downwards from the running position to the unlatched position, which disengages the latch dog (4) from latching pin (101) notch.

As shown in FIG. 5, downward displacement of the piston and push rod (3B) allows the latch dog (4) to move transversely into the push rod (3B) profile, thereby releasing the latching pin (101), which can then be pulled out of the tool. One surface (4A) of the latch dog (4) is beveled to match one side of the notch in the latching pin (101) profile. Thus, the latching pin (101) may be released with an upward movement of the latching pin (101) (and/or downward movement of the housing (1)), which pushes the latch dog (4) transversely, and the latching pin (101) may then be removed from the running tool (100).

Referring to FIG. 5, downward displacement of the piston (3A, 3B) within the housing (1) is limited by engagement of a shoulder (18) defined by the push rod (3B) with the top of the latch body (2).

Once the primary string with the running tool (100) is disconnected from the secondary string, the primary string may be pulled out, leaving the secondary string and latch sub (6) in place.

Interpretation.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The invention claimed is:

1. A tool for deploying a secondary string having a latching pin defining a latch notch, using a primary tubing string, the tool comprising:

(a) a housing adapted to connect to a far end of the primary tubing string, and defining an elongate slot along its length for through passage of a far end of the latching pin into the housing, and a transverse housing bypass port for fluid communication from inside to outside of the housing;

(b) a piston comprising a piston head slidingly disposed within the housing and responsive to fluid pressure for moving the piston from a running position to a unlatched position, and a push rod extending from the piston head and having a latch profile, the piston head having a valve with a valve passage in fluid communication with a transverse bypass passage which aligns with the housing bypass port when the piston is in a running position;

(c) a latch body disposed in the housing and defining an elongate channel configured to receive a far end of the push rod, a pin channel configured to receive the far end of the latching pin, and a transverse channel connecting the elongate channel and the pin channel; and (d) a latch dog disposed within the transverse channel;

(e) wherein when the piston is in the running position, the latch dog engages the latching pin notch, and when the piston is in the unlatched position, the latch dog engages the push rod latch profile and disengages from the latching pin profile.

2. The tool of claim 1, wherein the valve is a ball valve having a valve seat which engages a ball to close the valve.

3. The tool of claim 1, wherein the running tool further comprises a shear pin that engages the piston and the housing to retain the piston in the running position.

4. The tool of claim 1 wherein the latch body is slidingly moveable between an upper open position and a lower running position, and comprises a spring-loaded pin which engages an opening in the housing when in the running position.

5. A system comprising the tool of claim 1 and the latch sub comprising the latching pin defining the latch notch at its far end.

6. The system of claim 5 wherein the latching pin is S-curved.

7. The system of claim 5 wherein the latch sub comprises a shear sub.

8. A tool for deploying a secondary string having a latching pin defining a latch notch, using a primary tubing string, the tool comprising:

(a) a housing adapted to connect to a far end of the primary tubing string, and defining an elongate slot along its length for through passage of a far end of the latching pin into the housing, and a bypass port for fluid communication from inside to outside of the housing;

(b) a piston slidingly disposed within the housing and moveable between an upper open position and a lower running position, the piston comprising a piston head and a push rod extending from the piston head and having a latch profile;

(c) a valve disposed within the piston head, allowing fluid communication with the bypass port when open, and closing the tool to fluid pressure above the tool when closed;

(d) a latch body slidingly disposed in the housing and moveable between an upper open position and a running lower position, the latch body configured to receive a far end of the push rod and a far end of the latching pin;

(e) a latch dog disposed within a transverse channel defined by the latch body;

(f) wherein when the piston and the latch body are in the open position, the latch dog engages the push rod latch profile, allowing entry of the latching pin into the latch body, and when the piston and latch body are in the running position, the latch dog is pushed into the latching pin latch notch by the push rod latch profile, securely retaining the latching pin in the latch body.

9. The tool of claim 8, wherein the valve is a ball valve, activated by a ball dropped into the primary tubing to close the valve.

* * * * *